United States Patent [19]

Forster

[11] 4,419,990

[45] Dec. 13, 1983

[54] APPARATUS FOR RELIEVING THE SPINAL COLUMN

[76] Inventor: Helmut Forster, Greppenstrasse 77, 8031 Alling, Fed. Rep. of Germany

[21] Appl. No.: 236,109

[22] Filed: Feb. 19, 1981

[30] Foreign Application Priority Data

Feb. 29, 1980 [DE] Fed. Rep. of Germany ..... 3007835

[51] Int. Cl.[3] ..... A61H 1/02

[52] U.S. Cl. ..... 128/75; 272/145; 272/900

[58] Field of Search ..... 128/69, 70, 68, 71–75, 128/78, 84 R, 84 C; 272/900, 144–145

[56] References Cited

U.S. PATENT DOCUMENTS

| | | | |
|---|---|---|---|
| 2,938,695 | 5/1960 | Ciampa | 272/900 |
| 3,380,447 | 4/1968 | Martin | 128/75 |
| 3,593,708 | 8/1969 | Steele | 128/75 |
| 3,654,922 | 7/1970 | Outcalf | 128/75 |
| 4,241,915 | 12/1980 | Noble et al. | 272/145 |

FOREIGN PATENT DOCUMENTS

| | | | |
|---|---|---|---|
| 1400480 | 4/1965 | France | 272/900 |
| 2371211 | 7/1978 | France | 128/75 |
| 649788 | 12/1962 | Italy | 272/900 |

*Primary Examiner*—Richard J. Apley
*Assistant Examiner*—David J. Brown
*Attorney, Agent, or Firm*—Curtis, Morris & Safford

[57] ABSTRACT

In order to relieve the neck vertebrae or the lumbar vertebrae, a patient suspends himself, either by his head, using a Glisson sling, or by his feet, from a pivotable bracket mounted on one side of a support element which is connected to a counter-support by at least one flexible element which passes over the top of a door.

23 Claims, 3 Drawing Figures

FIG. 1
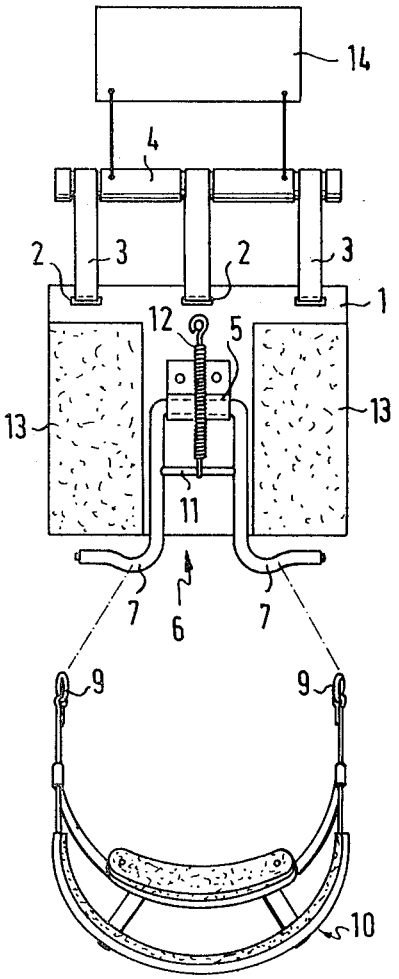
FIG. 2
FIG. 3
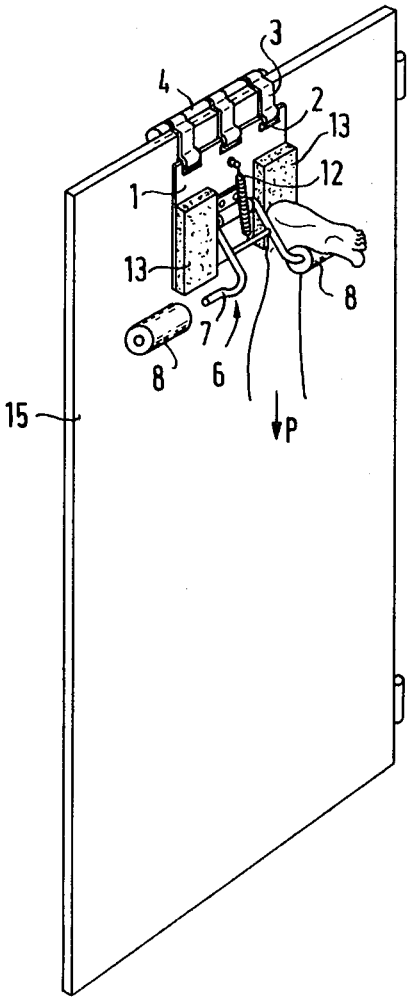

APPARATUS FOR RELIEVING THE SPINAL COLUMN

FIELD OF THE INVENTION

The present invention relates to apparatus for the relieving of the spinal column, more particularly the neck vertebrae or lumbar vertebrae, with a suspension device for the feet or a Glisson sling.

BACKGROUND OF THE INVENTION

Apparatus of the known kind usually comprise a suspension device in the form of a scaffolding or a physical exercise bar, supporting suitably dimensioned rings for engagement with the feet or a Glisson sling. If neck vertebrae are to be relieved, a Glisson sling is engaged with the rings of the suspension device to support the head of the patient. If on the other hand the lumbar vertebrae are to be relieved, the patient is suspended by the feet (head down) in suitable rings or retaining means so that the lumbar vertebrae are exposed to a relieving tensile stress due to the deadweight of the trunk, the arms, and the head.

Apparatus of this kind offers the advantage of alleviation to a patient suffering from damaged vertebrae if relief is applied by means of such apparatus at uniform intervals. However, such apparatus suffers from the disadvantage that it is normally fixedly installed on a wall or a supporting frame so that the patient must spend the treatment time at the installation site. As a consequence, for example in the case of a journey, treatment must be interrupted and this can lead to problems, particularly for patients with damaged spinal columns on long journeys.

OBJECT OF THE INVENTION

It is the object of the present invention to provide a completely novel apparatus for relieving the spinal column, more particularly the neck vertebrae or lumbar vertebrae, but having small dimensions, being relatively small and not bulky and therefore transportable but also being capable of attachment at any location without any special preparations.

SUMMARY OF THE INVENTION

According to the invention the suspension device comprises a bracket which is mounted on one side of a support element which is connected via a flexible connecting element to a counter-support.

The invention thus for the first time provides apparatus for relieving the spinal column which can accompany the patient at any time on journeys and can be used without problems practically at any location whenever required. A condition for the use of the apparatus is merely the presence of a door or gate. To mount the apparatus it is merely necessary for a door to be opened and for the apparatus to be placed above the top edge of the door by means of the flexible connecting element so that the support element bears on one side and the counter support on the other side of the door. If the door is then closed and the support element is pulled, the flexible connecting element will slide through the gap between the top edge of the door and the bottom edge of the door frame until the counter-support bears on the door or on the door frame. The patient can then suspend himself from the bracket attached to the support element, either by his feet or by means of a Glisson sling.

To remove the apparatus it is merely necessary to open the door and to remove the apparatus from the top edge thereof.

It is convenient to construct the support element as a plate, which can have a rectangular (e.g. square) or other shape. The support element can, however, comprise a simple frame or framework structure. In the case of a framework structure it is convenient to arrange this in double T configuration.

To prevent the support element from scratching the door it is convenient to provide the support element with padding on the side opposite to the bracket. Such padding can comprise a rubber plate or a layer of foam material. Any other kind of laminar material which will prevent scratching of the door when the apparatus is used, is equally suitable.

In one preferred embodiment, the bracket is substantially constructed in T configuration: the cross-piece of the T extends parallel with the support element while the foot of the T is mounted on the support element. An embodiment of this kind offers the advantage that engagement of the feet is relatively problem free for the patient. The patient, in handstand position in front of the door leaf, need merely thread his feet laterally into the T-shaped bracket.

In one advantageous embodiment the bracket is of double U configuration and the ends of the limbs are mounted on the support element. In this construction it is necessary for the patient to thread his feet from the handstand position from below into the bracket.

Advantageously the bracket is bent from round bar. An embodiment of this kind can be inexpensively produced and is moreover very stable.

To render treatment as pleasant as possible and to increase the stressing time it is convenient to apply padding to at least those regions which extend parallel with the support element, i.e. the regions into which the load of the feet is applied to the bracket. Such padding can be detachably arranged. An embodiment of this kind facilitates cleaning and moreover provides further means of use for the apparatus. For example, after removing the padding the patient can suspend himself by his hands from the bracket in order to relieve the spinal column. It is also convenient for the bracket to be provided with suspension regions for a Glisson sling. In the case of a bracket of T configuration it is possible, after removing any padding, to engage the suspension eyes of the Glisson sling simply over the cross-piece. It is, however, also possible to provide separate suspension regions, for example hooks or attachments.

Furthermore, threading in of the feet during the suspension operation is facilitated by virtue of the bracket being pivotably connected to the support element. The joint can be constructed in hinge configuration and can be arranged so that its pivot axis extends horizontally. Accordingly, during the threading operation, the bracket can be raised by means of the feet and the space between the bracket and the support element can therefore be enlarged for the purpose of facilitating entry.

A particularly simple entry or threading up of the feet into the bracket is obtained by a spring system which retains the bracket in an approximately horizontal alignment when the apparatus is in use on a door. This offers the advantage that, in its unstressed state, the apparatus has its largest opening width so that threading up of the feet is completely problem-free. If the patient then suspends himself with his feet on the bracket, the bracket will be pivoted downwardly against the force exerted by the spring so that, assuming a position with the back facing the door, the heels are pressed against the support element. The feet of the patient are thus firmly "clamped" between the support element and the bracket. To render the relieving time pleasant, it is convenient for padding to be also provided on the support element in the region of the heels on the side nearest to the bracket.

In one preferred embodiment of the apparatus, the flexible connecting element comprises at least two fabric strips. Fabric strips have a very slight thickness so that the apparatus can readily be used in conjunction with tightly closing steel doors. This also ensures that the rubber seal of such doors is not damaged in such a case. It is, however, possible to provide two or more belts as connecting element. Furthermore, the connecting element can also be constructed from a fabric web. To adapt the apparatus to the size of the patient or to the prevailing height of the door, it is convenient if the fabric web, the fabric strips or the belts are constructed so as to be longitudinally adjustable.

It is convenient to use a simple round bar as the counter-support. The round bar can be of wood, plastics, or a suitably sheathed metal. To produce a reliable connection between the round bar and the appropriate connecting element it is convenient to provide the round bar with one or more slots or recesses to receive the fabric web, the fabric strips, or the belts. To prevent the door from being opened by another person when the apparatus is being used, it is convenient for the counter-support to carry a warning sign or to be provided in some other manner with an instruction (for example "do not open the door" or "do not enter"). For standardized doors the counter-support can be associated with a safety device which renders unauthorized opening of the door impossible while the apparatus is being used. A safety device (not shown) can comprise a locking arm which, when tension is applied to the connecting element, pivots into a locking position in which it grips behind the door frame and thus prevents opening of the door. To this end it is however necessary for the support element with the bracket to be disposed on the side of the door facing the space into which the door opens.

BRIEF DESCRIPTION OF THE DRAWINGS

FIG. 1 shows apparatus for suspending a patient in order to relieve the spinal column;

FIG. 2 shows a known Glisson sling for use in conjunction with the apparatus of FIG. 1; and FIG. 3 shows the apparatus in the position of use on a door for relieving the lumbar vertebrae.

DESCRIPTION OF PREFERRED EMBODIMENT

The apparatus illustrated comprises a support element in the form of a rectangular plate 1 having three slots 2 in the region of its top edge, through which three fabric strips 3 extend. The strip 3 together constitute a flexible means functioning as a connecting element extending to a counter-support which, in the present embodiment, is constructed as a round bar 4.

Approximately in the middle of the plate 1 there is a hinge-like joint 5 by means of which the foot portion of a suspension means, in the form of a T-shaped bracket 6, is connected to the plate 1 so as to be pivotable about a horizontal axis. The cross-piece of the T-shaped bracket 6 is constituted by two lateral members 7 extending approximately parallel with the plane of the plate 1 and suitable for the engagement of rings of the Glisson sling 10 illustrated in FIG. 2.

The bracket 6 is also provided with a transverse member 11 on which one end of a tension spring 12 engages, the other end being connected to the plate 1 above the hinge 5. In the region of each lateral member 7 of the bracket, the plate 1 is also provided with padding 13.

A device (not shown) for limiting the pivoting angle of the bracket 6 is disposed within the hinge 5. The bracket 6 can therefore be pivoted by means of the spring 12 only into a position in which it is positioned substantially perpendicularly with respect to the plane of the plate 1. The spring 12 is, however, so dimensioned that the bracket 6 can be pivoted against the force of the spring without any substantial effort into a position in which it is parallel with the plane of the plate 1.

For use, the apparatus is suspended over the top edge of an open door 15 (as shown in FIG. 3) and the door is closed. If tension is then applied to the plate 1 or to the bracket 6 in the direction of the arrow P, the fabric strips 3 will slide through the gap above the top edge of the door 15, until the bar 4 bears upon the door or the door frame. A notice 14, warning persons not to open the door, hangs from the bar 4. The apparatus is then ready for use by the patient.

To relieve the lumbar vertebrae the patient, in handstand position and with his back to the door, merely threads his feet into the space between the plate 1 and the bracket 6, as indicated in FIG. 3. Under the weight of the patient, the bracket 6 pivots, against the force of the spring 12, in the direction of the arrow P, so that the heels of the patient's feet are firmly pressed against the two regions of padding 13. This results in a certain clamping action which ensures reliable securing of the patient's feet.

At the end of the relieving time the patient merely raises himself by his hands a certain amount. Under the effect of the spring 12 the bracket 6 will then pivot into its perpendicular position in relation to the plate 1 so that the clamping action is cancelled and the patient can pull out his feet laterally from between the bracket 6 and the plate 1.

To render the treatment time pleasant and to avoid pressure marks on the feet when the lumbar vertebrae are relieved, it is convenient to slide padding (see FIG. 3) on to the cross members 7 of the bracket 6. This padding, which can have the form of rollers 8 (as shown), is removed when the members 7 are to engage the rings 9 of the Glisson sling 10 (as indicated in FIG. 1).

I claim:

1. A portable apparatus for relieving the spinal column, comprising a support element, a counter-support sized to bear against at least the top of a typical closed door or its door frame without passing through the slot therebetween, flexible means connecting the support element to the counter-support and sized to pass through said slot, and suspension means in the form of a bracket of generally T-shaped configuration having a cross-piece extending generally parallel to the support element in a manner to engage and fully suspend a patient by his feet or by a head sling and having a foot portion solely pivotally attached to said support element so as to afford a range of rotation of said bracket between a position substantially perpendicular to said support element and a downward position substantially parallel to said support element when in use mounted on said door through said slot.

2. The apparatus of claim 1, in which the foot of said generally T-shaped bracket is of a U configuration having a base and two legs and wherein the base of said U forms a hinge portion and the cross-piece of said bracket is formed of two lateral members extending opposingly outwardly each from the end of a respective leg of said foot and each being in line with the other and parallel to the base of said foot and to said support element.

3. The apparatus of claim 1, in which the support element comprises a plate.

4. The apparatus of claim 3, in which the plate is rectangular.

5. The apparatus of claim 1, in which the support element comprises a frame.

6. The apparatus of claim 1, further comprising padding on the side of the support element opposite to the said one side on which the suspension means is mounted.

7. The apparatus of claim 6, in which the padding comprises a layer of rubber or foam material.

8. The apparatus of claim 1, further comprising padding on the said one side of the support element.

9. The apparatus of claim 1, in which the bracket is bent from a round bar.

10. The apparatus of claim 1, in which regions of the bracket which extend parallel with the support element are provided with padding.

11. The apparatus of claim 12, in which the padding is removable.

12. The apparatus of claim 1, in which the bracket is provided with suspension regions for a Glisson sling.

13. The apparatus of claim 1, in which the bracket is pivotally biased to orient substantially perpendicular to the support element.

14. The apparatus of claim 1, in which the bracket is connected to the support element by a hinge whose axis extends horizontally when said apparatus is in use mounted on said door.

15. The apparatus of claim 1, further comprising spring means for biasing the bracket to an approximately horizontal position when said apparatus is in use mounted on said door.

16. The apparatus of claim 1, in which the flexible connecting means comprises at least two fabric strips.

17. The apparatus of claim 1, in which the flexible connecting means comprises at least two belts.

18. The apparatus of claim 1, in which the flexible connecting means comprises a fabric web.

19. The apparatus of claim 1, in which the flexible connecting means is of adjustable length.

20. The apparatus of claim 1, in which the counter-support comprising a bar.

21. The apparatus of claim 20, in which the bar has slots or recesses for receiving the flexible connecting means.

22. The apparatus of claim 1, in which the counter-support is provided with a warning sign.

23. The apparatus of claim 1, in which the counter-support is associated with a safety device for preventing the opening of a door over which the apparatus is fitted.

* * * * *